US011733628B2

(12) United States Patent
Takahashi

(10) Patent No.: US 11,733,628 B2
(45) Date of Patent: Aug. 22, 2023

(54) FIXING DEVICE INCLUDING A HEATER INSERTED INTO HEATING ROLLER WITH BEING CONNECTED TO TERMINALS AND IMAGE FORMING APPARATUS INCLUDING THE FIXING DEVICE

(71) Applicant: KYOCERA Document Solutions Inc., Osaka (JP)

(72) Inventor: Hironori Takahashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/583,349

(22) Filed: Jan. 25, 2022

(65) Prior Publication Data

US 2022/0236677 A1 Jul. 28, 2022

(30) Foreign Application Priority Data

Jan. 27, 2021 (JP) ..... 2021-011176

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS 6,275,669 B1 * 8/2001 Hasegawa ..... G03G 15/2053 399/90
7,720,420 B2 * 5/2010 Kajita ..... G03G 15/2053 399/70
7,920,815 B2 * 4/2011 Miyake ..... G03G 15/2053 399/328
10,078,300 B2 * 9/2018 Samei ..... G03G 15/2039

FOREIGN PATENT DOCUMENTS

JP H07-311507 11/1995

* cited by examiner

*Primary Examiner* — Arlene Heredia
(74) *Attorney, Agent, or Firm* — Lex IP Meister, PLLC

(57) ABSTRACT

The fixing device includes a heating roller and a pressure roller. The heating roller has a rotating member, a heating member, and a support member. The heating member has a heater, a first terminal, and a second terminal. The heater generates heat by energization. The first terminal is connected to one end of the heater. The second terminal is connected to the other end of the heater. The first terminal protrudes from one end of the rotating member in the longitudinal direction of the rotating member and is hooked on a hook provided on the support member so as to be movable along the longitudinal direction. The second terminal protrudes from the other end of the rotating member in the longitudinal direction and is fixed to the support member so as not to be movable along the longitudinal direction.

6 Claims, 7 Drawing Sheets

FIXING DEVICE INCLUDING A HEATER INSERTED INTO HEATING ROLLER WITH BEING CONNECTED TO TERMINALS AND IMAGE FORMING APPARATUS INCLUDING THE FIXING DEVICE

INCORPORATION BY REFERENCE

This application claims priority on the basis of Japanese Application No. 2021-011176, filed Jan. 27, 2021, and incorporates the contents of said application.

BACKGROUND

The present disclosure relates to a fixing device and an image forming apparatus.

In general, an image forming apparatus includes a fixing device for fixing a toner image to a recording medium. The fixing device includes a heating roller and a pressure roller. The heating roller has a rotating member, a heating member, and a support member. The heating member is arranged in the rotating member, a metal terminal connected to the end of the heating member is fixed to a nut by a screw, and the nut is inserted into a guide groove formed in the support member. Since the nut can move in the longitudinal direction of the rotating member, the influence of thermal expansion of each part is reduced.

In the conventional image forming apparatus, when the nut receives a rotational force in the guide groove, the movement of the nut is inhibited. As a result, there was a possibility of damaging the heating member due to thermal expansion.

SUMMARY

A fixing device according to the present disclosure includes a heating roller and a pressure roller. The heating roller heats the recording medium on which the toner image is formed. The pressure roller pressurizes the recording medium with the heating roller. The heating roller has a rotating member, a heating member, and a support member. The rotating member has a hollow part and rotates around a rotary shaft along the longitudinal direction. The heating member generates heat in a state of being inserted into the hollow part. The support member supports the rotating member and the heating member. The heating member has a heater, a first terminal, and a second terminal. The heater generates heat by energization. The first terminal is connected to one end of the heater. The second terminal is connected to the other end of the heater. The first terminal protrudes from one end of the rotating member in the longitudinal direction and is hooked on a hook provided on the support member so as to be movable along the longitudinal direction. The second terminal protrudes from the other end of the rotating member in the longitudinal direction and is fixed to the support member so as not to be movable along the longitudinal direction.

The image forming apparatus of the present disclosure includes the fixing device and the image forming section. The image forming section forms the toner image on the recording medium. The fixing device fixes the toner image on the recording medium.

The purpose, features, and advantages of the present disclosure are further illustrated by the detailed description below. The detailed description refers to the accompanying drawings, which show preferred embodiments of the present disclosure.

BRIEF DESCRIPTION OF THE INVENTION

DETAILED DESCRIPTION

Figure 1:
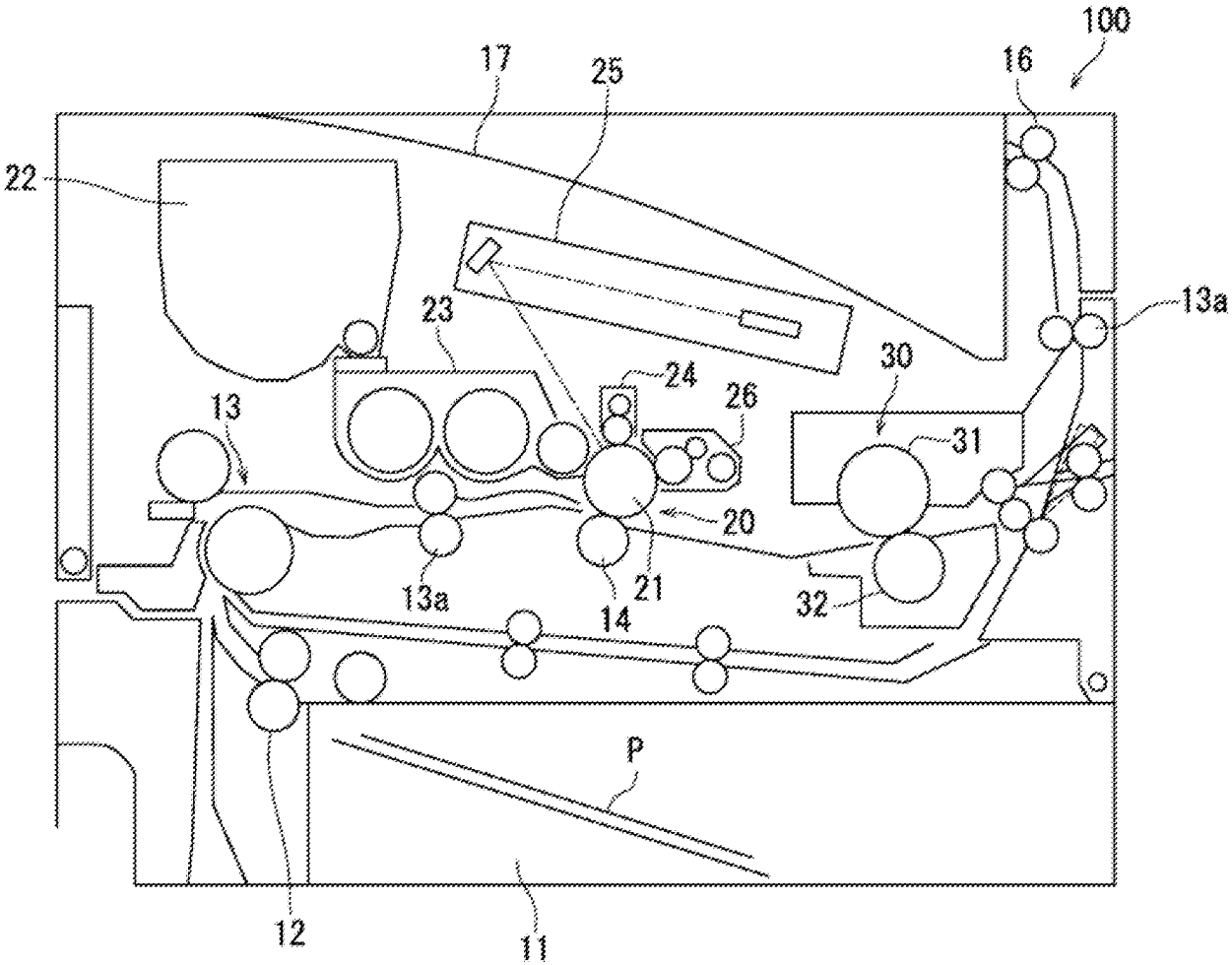
FIG. 1 is a schematic diagram showing an example of the structure of an image forming apparatus according to an embodiment.

Embodiments of the present disclosure will be described with reference to the drawings. In the drawings, the same or corresponding portions are denoted by the same reference numerals and the description is not repeated.

An image forming apparatus 100 according to an embodiment will be described with reference to FIG. 1. FIG. 1 is a schematic diagram showing an example of the configuration of the image forming apparatus 100. The image forming apparatus 100 is, for example, a printer.

As shown in FIG. 1, the image forming apparatus 100 includes a paper feed cassette 11, a paper feed roller 12, a conveyance path 13, a plurality of conveyance rollers 13*a*, a transfer roller 14, a discharge roller 16, a discharging section 17, an image forming section 20, and a fixing device 30. Each of the plurality of conveyance rollers 13*a* is provided in the conveyance path 13.

The paper feed cassette 11 can store a plurality of recording media P (for example, printing paper). The paper feed roller 12 feeds the recording medium P in the paper feed cassette 11 one by one to the conveyance path 13. The conveyance roller 13*a* conveys the recording medium P fed to the conveyance path 13 toward the image forming section 20.

An image forming section 20 forms a toner image on a recording medium P. The image forming section 20 includes a photosensitive drum 21, a toner container 22, a developing device 23, a charging device 24, an exposure device 25, and a cleaning device 26.

The charging device 24 uniformly charges the photosensitive drum 21 to a predetermined polarity by discharge. The exposure device 25 irradiates the charged photosensitive drum 21 with a laser beam. Thus, an electrostatic latent image is formed on the surface of the photosensitive drum 21.

The developing device 23 develops an electrostatic latent image formed on the surface of the photosensitive drum 21 to form a toner image. The toner container 22 supplies toner to the developing device 23. The developing device 23 supplies the toner replenished from the toner container 22 to the surface of the photosensitive drum 21. As a result, a toner image is formed on the surface of the photosensitive drum 21.

The transfer roller 14 transfers the toner image formed on the surface of the photosensitive drum 21 to the recording medium P. The recording medium P on which the toner image is transferred is conveyed toward the fixing device 30. The cleaning device 26 cleans the residual toner on the surface of the photosensitive drum 21.

The fixing device 30 fixes the toner image on the recording medium P. The fixing device 30 includes a heating roller 31 and a pressure roller 32. The heating roller 31 and the pressure roller 32 are arranged to face each other to form a fixing nip. The heating roller 31 heats the recording medium P on which the toner image is formed. The pressure roller 32 pressurizes the recording medium P with the heating roller 31. The recording medium P is pressurized while being heated at a predetermined fixing temperature by passing through the fixing nip. As a result, the toner image is fixed to the recording medium P.

The recording medium P on which the toner image has been fixed is conveyed from the fixing device 30 toward the discharging section 17 by the conveyance roller 13*a* and the discharge roller 16.

Figure 2:
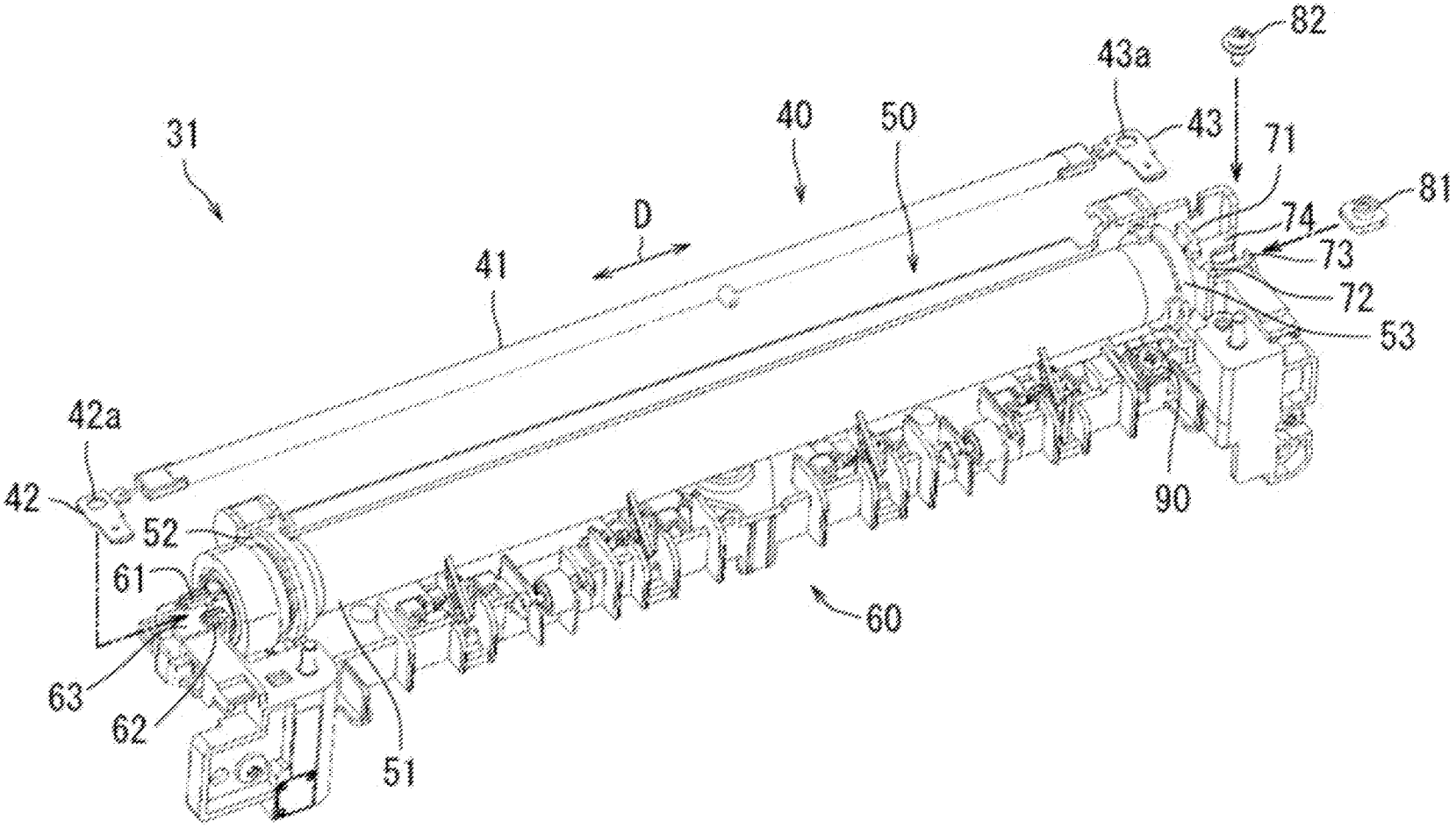
FIG. 2 is an exploded perspective view showing the entire structure of a heating roller constituting a part of the fixing device.
Figure 3:
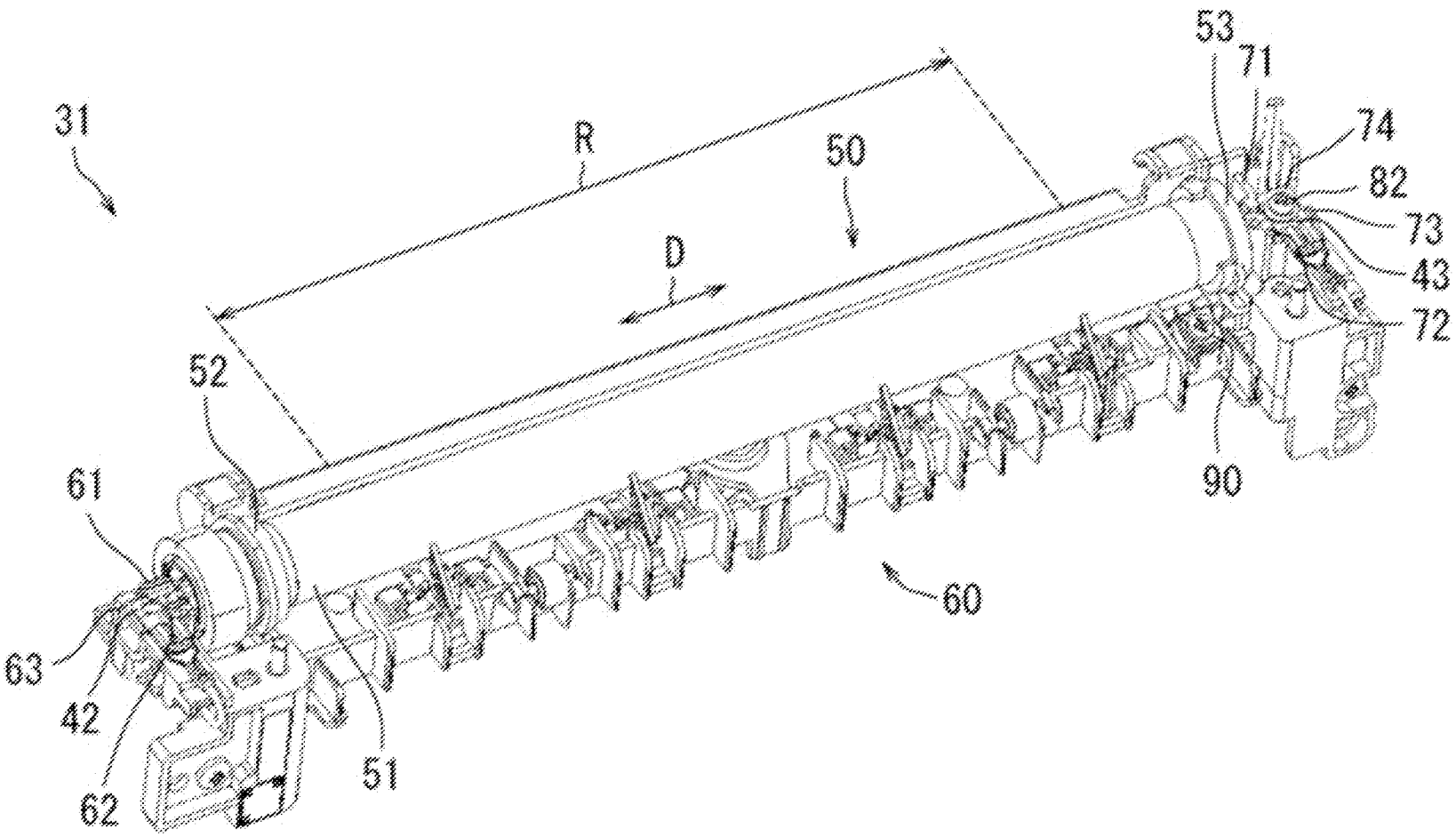
FIG. 3 is a perspective view showing the overall configuration of the heating roller.

Next, referring to FIGS. 2 and 3, a description will be given of a heating roller 31 constituting a part of the fixing device 30. FIG. 2 is an exploded perspective view showing the overall configuration of the heating roller 31. FIG. 3 is a perspective view showing the overall configuration of the heating roller 31.

As shown in FIGS. 2 and 3, the heating roller 31 includes a rotating member 50, a heating member 40, and a support member 60. The rotating member 50 has a hollow part and rotates around a rotary shaft along the longitudinal direction D. The heating member 40 generates heat while being inserted into the hollow portion of the rotating member 50. The support member 60 supports the rotating member 50 and the heating member 40. The support member 60 is made of synthetic resin, for example.

The heating member 40 has a heater 41, a first terminal 42, and a second terminal 43. The heater 41 generates heat by energization. The heater 41 is, for example, a halogen heater. The first terminal 42 is a metal terminal connected to one end of the heater 41. The first terminal 42 has a shape in which two rectangular plates of different sizes are connected to each other, and has a hole 42*a* penetrating in the thickness direction. The second terminal 43 is a metal terminal connected to the other end of the heater 41. The second terminal 43 has the same shape as the first terminal 42 and has a hole 43*a* penetrating in the thickness direction.

The heater 41 extends along the longitudinal direction D of the rotating member 50. As shown in FIG. 3, the first terminal 42 protrudes from one end of the rotating member 50 in the longitudinal direction D and is hooked on the first hook 61 and the second hook 62 provided on the support member 60 so as to be movable along the longitudinal direction D. The second terminal 43 protrudes from the other end of the rotating member 50 in the longitudinal direction D and is fixed to the support member 60 so as not to be movable along the longitudinal direction D.

The rotating member 50 has a body portion 51, a first bush 52, and a second bush 53. The body portion 51 is a tubular body having an outer peripheral surface. The body portion 51 is made of a conductive material such as aluminum. A mold release layer is formed in the central portion of the outer peripheral surface of the body portion 51. As shown in FIG. 3, the sheet passing region R, which indicates the region through which the recording medium P passes, is included in the region where the mold release layer is formed. The first bush 52 is fitted in the outer peripheral surface of the body portion 51 on the side of the first terminal 42 in the longitudinal direction D. The first bush 52 constitutes a part of the first sliding bearing. The second bush 53 is fitted in the outer peripheral surface of the body portion 51 on the side of the second terminal 43 in the longitudinal direction D. The second bush 53 constitutes a part of the second sliding bearing. The first bush 52 is non-conductive and the second bush 53 is conductive. The first bush 52 may have insulating properties.

The heating roller 31 further includes a temperature sensor 90 for detecting the surface temperature of the heating roller 31. The temperature sensor 90 is, for example, a thermistor. The temperature sensor 90 is fixed to the support member 60 in the vicinity of the second terminal 43 outside the sheet passing region R.

Figure 4:
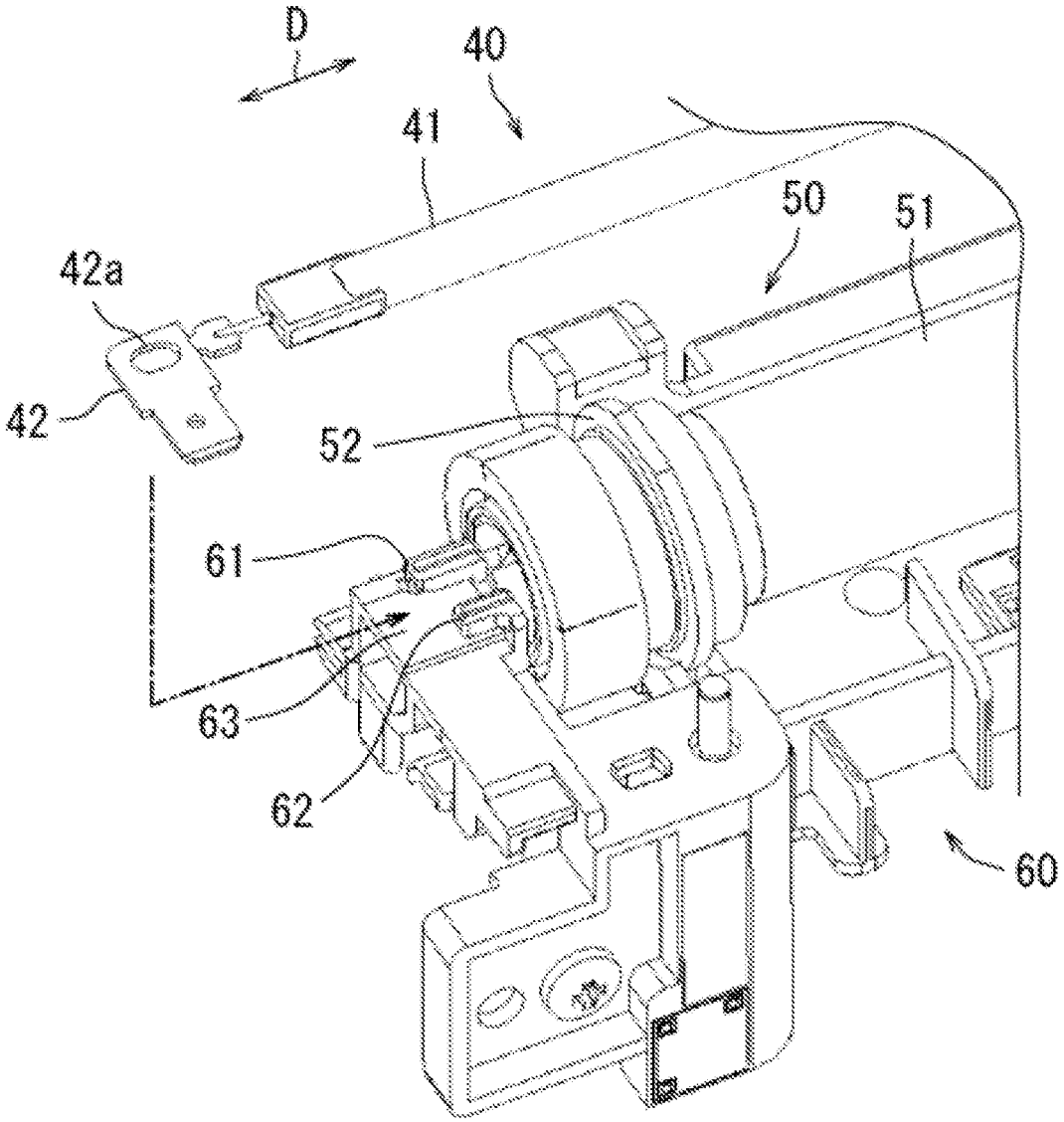
FIG. 4 is an exploded perspective view showing an end configuration of the heating roller on the first terminal side.
Figure 5:
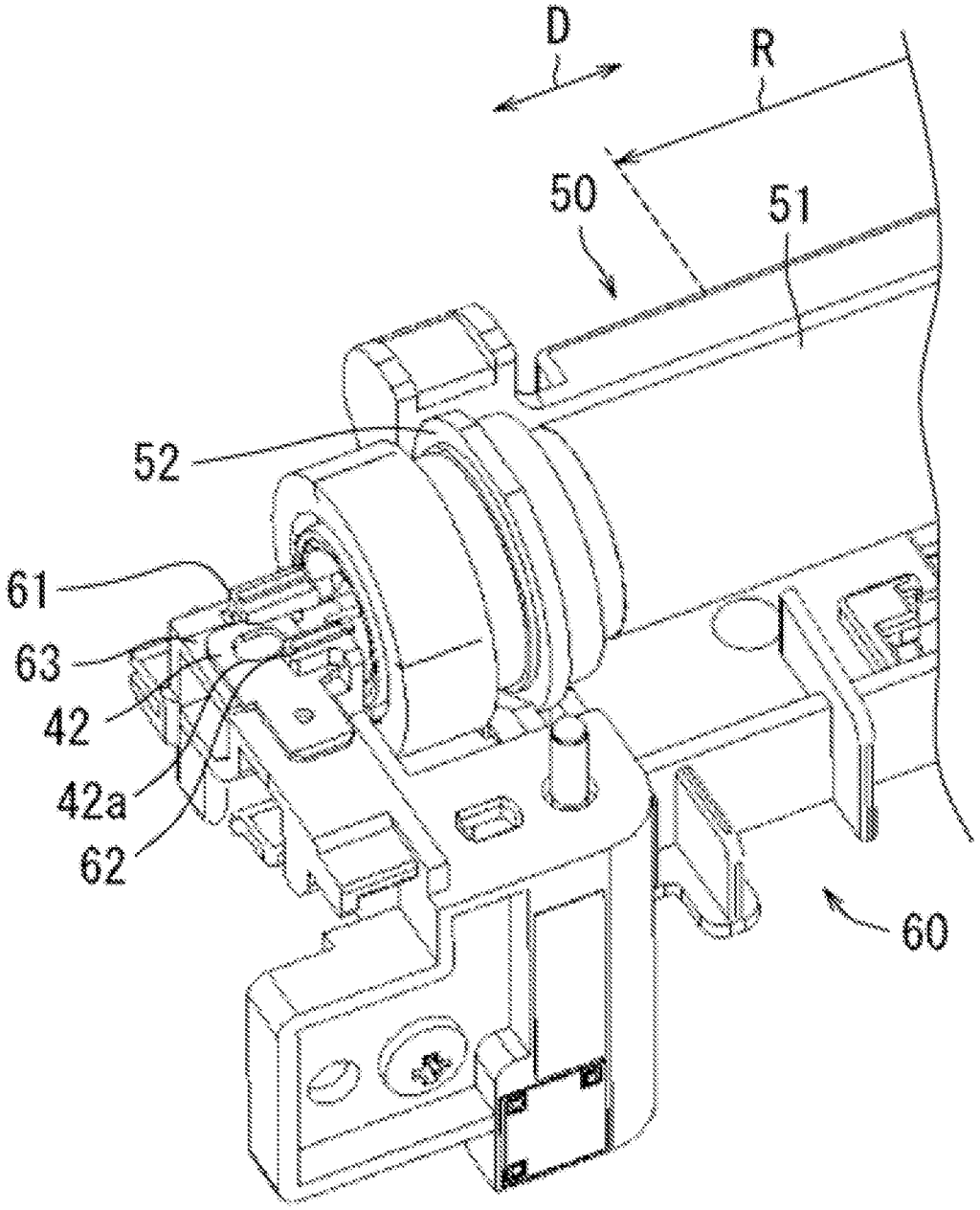
FIG. 5 is a perspective view showing the end configuration of the heating roller on the first terminal side.

Next, with reference to FIGS. 4 and 5, the end configuration of the heating roller 31 on the side of the first terminal 42 will be described in detail. FIG. 4 is an exploded perspective view showing the end structure of the heating roller 31 on the side of the first terminal 42. FIG. 5 is a perspective view showing an end configuration of the heating roller 31 on the side of the first terminal 42.

As shown in FIGS. 4 and 5, the support member 60 has a first flat plate part 63 in addition to the first hook 61 and the second hook 62. The first hook 61 extends along a direction intersecting the longitudinal direction D from the first flat plate part 63, and extends parallel to the first flat plate part 63 and away from the first bush 52. The second hook 62 also extends along a direction intersecting the longitudinal direction D from the first flat plate part 63 and extends parallel to the first flat plate part 63 and away from the first bush 52. The first terminal 42 is hooked on the first hook 61 and the second hook 62 while being placed on the first flat plate part 63. As a result, the first terminal 42 is sandwiched between the first flat plate part 63, the first hook 61 and the second hook 62, and can move along the longitudinal direction D. The hole 42*a* of the first terminal 42 is not used.

Figure 6:
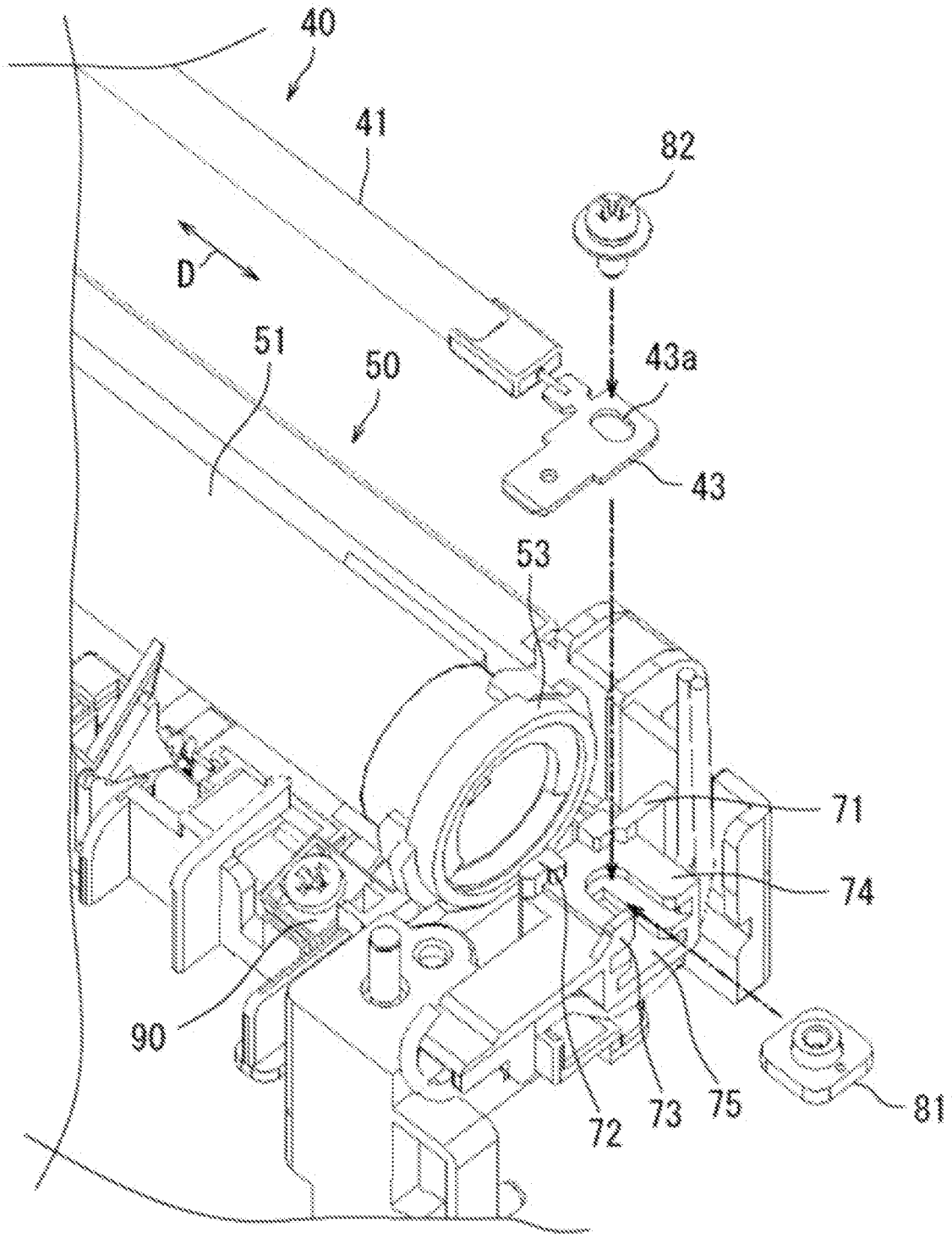
FIG. 6 is an exploded perspective view showing the configuration of the second terminal side end of the heating roller.
Figure 7:
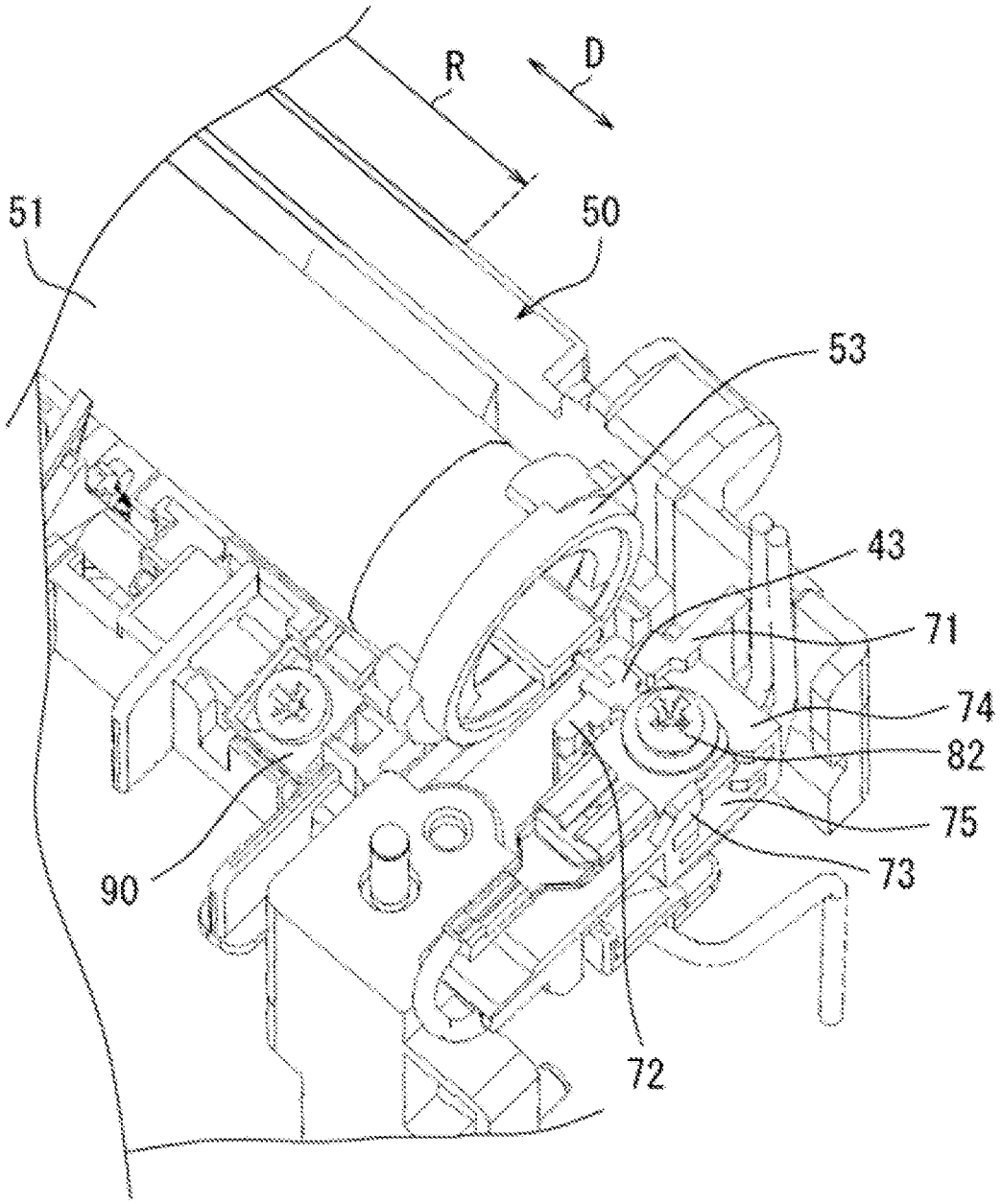
FIG. 7 is a perspective view showing the configuration of the second terminal side end of the heating roller.

Next, with reference to FIGS. 6 and 7, the end configuration of the heating roller 31 on the side of the second terminal 43 will be described in detail. FIG. 6 is an exploded perspective view showing an end configuration of the heating roller 31 on the side of the second terminal 43. FIG. 7 is a perspective view showing an end configuration of the heating roller 31 on the side of the second terminal 43.

As shown in FIG. 6, the support member 60 includes a first rib 71, a second rib 72, a third rib 73, a second flat plate part 74, and a recessed portion 75. The second terminal 43 is placed on the second flat plate part 74, and is fixed by a nut 81 and a screw 82 in a state where movement along the longitudinal direction D is restricted by the first rib 71, the second rib 72 and the third rib 73. More specifically, the nut 81 is inserted into the recessed portion 75 formed adjacent to the second flat plate part 74, and the screw 82 is inserted into the hole 43*a* of the second terminal 43. The second terminal 43 is fixed by tightly screwing the nut 81 and the screw 82.

According to the embodiment, since the first terminal 42 can move along the longitudinal direction D, there are provided a fixing device 30 and an image forming apparatus 100 capable of substantially mitigating the influence of thermal expansion.

Moreover, according to the embodiment, since the first bush 52 is non-conductive or insulating, the spark failure of the heater 41 can be suppressed even if the first hook 61 and the second hook 62 are damaged.

According to the embodiment, the temperature sensor 90 is fixed near the second terminal 43. Therefore, the positional accuracy of the temperature sensor 90 relative to the heater 41 in the longitudinal direction D is relatively high as compared with the case where the temperature sensor 90 is fixed in the vicinity of the first terminal 42, and high-precision temperature control of the heating roller 31 is achieved.

Embodiments of the present disclosure have been described with reference to the drawings. However, the present disclosure is not limited to the embodiments described above, and may be implemented in various aspects without departing from the spirit thereof. Various embodiments can be formed by suitably combining the plurality of components disclosed in the above embodiments. For example, some components may be removed from all components shown in the embodiment. The drawings schematically show the respective components for the sake of easy understanding, and the number of the illustrated components may differ from the actual number due to the convenience of drawing preparation. Each of the components shown in the above embodiment is an example, and is not particularly limited, and various changes can be made without substantially departing from the effect of the present invention.

Although the image forming apparatus 100 is a printer in the embodiment, the present invention is not limited thereto. The image forming apparatus 100 may be, for example, a composite machine having a function of a copying machine, a printer, and a facsimile.

The present disclosure is applicable to the field of fixing devices and image forming apparatuses.

The invention claimed is:

1. A fixing device comprising:

a heating roller heating a recording medium on which a toner image is formed; and a pressure roller pressurizing the recording medium with the heating roller, wherein the heating roller includes:

a rotating member having a hollow portion and rotating about a rotary shaft along a longitudinal direction;

a heating member which generates heat in a state of being inserted into the hollow portion; and a support member supporting the rotating member and the heating member, wherein the heating member includes:

a heater which generates heat by energization;

a first terminal connected to one end of the heater in the longitudinal direction;

a second terminal connected to other end of the heater in the longitudinal direction, wherein the first terminal protrudes from one end of the rotating member in the longitudinal direction and is movably hooked on a hook provided on the support member so as to be movable along the longitudinal direction with being sandwiched between the support member and the hook, wherein the second terminal has a hole into which the screw is inserted, wherein the support member includes a recessed portion formed adjacent to the second flat plate part, and wherein the second terminal protrudes from the other end of the rotating member in the longitudinal direction and is fixed to the support member by screwing a nut that is inserted into the recessed portion, and the screw so as not to be movable along the longitudinal direction.

2. The fixing device according to claim 1, wherein the rotating member includes:

a tubular body portion having an outer peripheral surface;

a first bush fitted into the outer peripheral surface on a side of the first terminal in the longitudinal direction; and a second bush fitted into the outer peripheral surface on a side of the second terminal in the longitudinal direction, and the first bush is non-conductive and the second bush is conductive.

3. The fixing device according to claim 1, further comprising:

a temperature sensor detecting a surface temperature of the heating roller, wherein the temperature sensor is fixed to the support member in the vicinity of the second terminal outside of a sheet passing region indicating a region through which the recording medium passes.

4. The fixing device according to claim 1, wherein the heater is a halogen heater.

5. An image forming apparatus comprising:

the fixing device according to claim 1; and an image forming section forming the toner image on the recording medium, and wherein the fixing device fixes the toner image to the recording medium.

6. A fixing device comprising:

a heating roller heating a recording medium on which a toner image is formed; and a pressure roller pressurizing the recording medium with the heating roller, wherein the heating roller includes:

a rotating member having a hollow portion and rotating about a rotary shaft along a longitudinal direction;

a heating member which generates heat in a state of being inserted into the hollow portion; and a support member supporting the rotating member and the heating member, wherein the heating member includes:

a heater which generates heat by energization;

a first terminal connected to one end of the heater in the longitudinal direction; and a second terminal connected to other end of the heater in the longitudinal direction, wherein the support member includes:

a first flat plate part on which the first terminal is placed, a pair of hooks which extend along a direction intersecting the longitudinal direction from the first flat plate part and then extend parallel to the first flat plate part along the longitudinal direction, a second flat plate part on which the second terminal is placed, and a plurality of ribs extending from the second flat plate part, wherein the first terminal and the second terminal are metal terminals each having a shape in which two rectangular plates of different sizes are connected to each other, wherein the heater to which the first terminal and the second terminal are connected is inserted into the hollow portion of the rotating member to be placed therein, the first terminal protrudes from one end of the rotating member in the longitudinal direction and is hooked on the pair of hooks placed on the first flat plate part included in the support member so as to be movable along the longitudinal direction and be restricted to move in the direction intersecting the longitudinal direction, and the second terminal protrudes from the other end of the rotating member in the longitudinal direction and is fixed to the support member by a screw with being placed on the second flat plate part so as to be restricted, by the plurality of ribs, to move along the longitudinal direction on the second flat plate part.

* * * * *